US006734628B2

(12) United States Patent
Seki et al.

(10) Patent No.: US 6,734,628 B2
(45) Date of Patent: May 11, 2004

(54) DISCHARGE LAMP, LAMP UNIT AND IMAGE DISPLAY APPARATUS

(75) Inventors: Tomoyuki Seki, Osaka (JP); Makoto Horiuchi, Nara (JP); Makoto Kai, Osaka (JP); Tsuyoshi Ichibakase, Osaka (JP); Mamoru Takeda, Kyoto (JP); Shinichi Yamamoto, Osaka (JP); Kenichi Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 50 days.

(21) Appl. No.: 09/870,344

(22) Filed: May 30, 2001

(65) Prior Publication Data

US 2001/0048273 A1 Dec. 6, 2001

(30) Foreign Application Priority Data

May 31, 2000 (JP) ..... 2000-162286

(51) Int. Cl.[7] ..... H01J 17/18

(52) U.S. Cl. ..... 313/623; 313/489; 313/634; 313/635; 313/636

(58) Field of Search ..... 313/489, 634, 313/635, 636

(56) References Cited

U.S. PATENT DOCUMENTS

| | | | | |
|---|---|---|---|---|
| RE34,492 | E | * 12/1993 | Roberts | 359/48 |
| 5,789,850 | A | * 8/1998 | Iwafuji et al. | 313/318.08 |
| 5,966,250 | A | * 10/1999 | Shimizu | 359/727 |
| 6,084,352 | A | 7/2000 | Seki et al. | |
| 6,294,870 | B1 | * 9/2001 | Kawashima et al. | 313/623 |

FOREIGN PATENT DOCUMENTS

| | | |
|---|---|---|
| EP | 0 866 488 A1 | 9/1998 |
| JP | 51-76874 | 7/1976 |
| JP | 63241850 A | 10/1988 |
| JP | 04184857 A | 7/1992 |
| JP | 05251055 A | 9/1993 |
| JP | 07230791 A | 8/1995 |
| JP | 09180501 A | 7/1997 |
| JP | 09230258 A | 9/1997 |
| JP | 09274889 A | 10/1997 |
| JP | 10092385 A | 4/1998 |
| JP | 10134767 A | 5/1998 |
| JP | 10247475 A | 9/1998 |
| JP | 10284005 A | 10/1998 |
| JP | 10294013 A | 11/1998 |
| JP | 10-321135 | 12/1998 |
| JP | 11264944 A | 9/1999 |
| JP | 2000231903 A | 8/2000 |

* cited by examiner

*Primary Examiner*—Nimeshkumar D. Patel
*Assistant Examiner*—Holly Harper
(74) *Attorney, Agent, or Firm*—Harness, Dickey & Pierce, P.L.C.

(57) ABSTRACT

A discharge lamp includes a luminous bulb in which a luminous material is enclosed and a pair of electrodes are opposed to each other in the luminous bulb; and a pair of sealing portions for sealing a pair of metal foils electrically connected to the pair of electrodes, respectively. Each of the pair of metal foils has an external lead on a side opposite to a side electrically connected to a corresponding electrode of the pair of electrodes. At least one of the pair of sealing portions is provided with a reflective film on a surface of the sealing portion in a portion where a connection portion of the external lead and the metal foil is sealed. The reflective film contains a material having a reflectance larger than that of a material constituting the sealing portion.

5 Claims, 7 Drawing Sheets

DISCHARGE LAMP, LAMP UNIT AND IMAGE DISPLAY APPARATUS

BACKGROUND OF THE INVENTION

The present invention relates to a discharge lamp and a lamp unit. In particular, the present invention relates to a discharge lamp and a lamp unit used as a light source for projectors using a digital micromirror device (DMD) or a light source for a liquid crystal projector. The present invention also relates to an image display apparatus including such a discharge lamp or discharge unit.

In recent years, an image projection apparatus such as a projector using a DMD (digital light processing (DLP) projector) or a liquid crystal projector has been widely used as a system for realizing large-scale screen images. A high-pressure discharge lamp having a high intensity has been commonly and widely used in such an image projection apparatus. In the image projection apparatus, light is required to be concentrated on an imaging device (DMD panel or liquid crystal panel or the like) included in the optical system of the projector, so that in addition to high intensity, it is also necessary to achieve a light source close to a point light source. Therefore, among high-pressure discharge lamps, a short arc ultra high pressure mercury lamp that is close to a point light and has a high intensity has been noted widely as a promising light source.

Referring to FIG. 5, a conventional short arc ultra high pressure mercury lamp 1000 will be described. FIG. 5 is a schematic top view of an ultra high pressure mercury lamp 1000. The lamp 1000 includes a substantially spherical luminous bulb 110 made of quartz glass, and a pair of sealing portions (seal portions) 120 and 120' made of also quartz glass and connected to the luminous bulb 110.

A discharge space 115 is inside the luminous bulb 110. A mercury 118 in an amount of the enclosed mercury of, for example, 150 to 250 mg/cm$^3$ as a luminous material, a rare gas (e.g., argon with several tens kPa) and a small amount of halogen are enclosed in the discharge space 115. A pair of tungsten electrodes (W electrode) 112 and 112' are opposed with a certain distance (e.g., about 1.5 mm) in the discharge space 115. Each of the W electrodes 112 and 112' includes an electrode axis (W rod) 116 and a coil 114 wound around the head of the electrode axis 116. The coil 114 has a function to reduce the temperature at the head of the electrode.

The electrode axis 116 of the electrode 112 is welded to a molybdenum foil (Mo foil) 124 in the sealing portion 120, and the W electrode 112 and the Mo foil 124 are electrically connected by a welded portion 117 where the electrode axis 116 and the Mo foil 124 are welded. The sealing portion 120 includes a glass portion 122 extended from the luminous bulb 110 and the Mo foil 124. The glass portion 122 and the Mo foil 124 are attached tightly so that the airtightness in the discharge space 115 in the luminous bulb 110 is maintained. In other words, the sealing portion 120 is sealed by attaching the Mo foil 124 and the glass portion 122 tightly for foil-sealing. Both of the sealing portions 120 have a circlar cross section, and the rectangular Mo foil 124 is disposed in the center of the inside of the sealing portion 120.

The Mo foil 124 of the sealing portion 120 includes an external lead (Mo rod) 130 made of molybdenum on the side opposite to the side on which the welded portion 117 is positioned. The Mo foil 124 and the external lead 130 are welded with each other so that the Mo foil 124 and the external lead 130 are electrically connected at a welded portion 132. The structures of the W electrode 112' and sealing 120' are the same as those of the W electrode 112 and sealing 120, so that description thereof will be omitted.

Next, the operational principle of the lamp 1000 will be described. When a start voltage is applied to the W electrodes 112 and 112' via the external leads 130 and the Mo foils 124, discharge of argon (Ar) occurs. Then, this discharge raises the temperature in the discharge space 115 of the luminous bulb 110, and thus the mercury 118 is heated and evaporated. Thereafter, mercury atoms are excited and become luminous in the arc center between the W electrodes 112 and 112'. As the pressure of the mercury vapor of the lamp 1000 is higher, the emission efficiency is higher, so that the higher pressure of the mercury vapor is suitable as a light source for an image projection apparatus. However, in view of the physical strength against pressure of the luminous bulb 110, the lamp 1000 is used at a mercury vapor pressure of 15 to 25 MPa.

As shown in FIG. 6, the lamp 1000 can be formed into a lamp unit 1200 in combination with a reflecting mirror 60. FIG. 6 is a schematic cross-sectional view of the lamp unit 1200. The lamp unit 1200 can be used as a light source of DLP projectors or liquid crystal projectors, for example.

The lamp unit 1200 includes the discharge lamp 1000 and the reflecting mirror 60 for reflecting light emitted from the discharge lamp 1000, and the light emitted from the discharge lamp 1000 is reflected at the reflecting mirror 60 and emits in the emission direction 50. The reflecting mirror 60 has a front opening **60*a* on the side of the emission direction 50. A front glass (not shown) is to be attached at the front opening 60*a* for the purpose of preventing scattering at the time of lamp breakage. A lead wire 65 is electrically connected to the external lead 130 of the sealing portion 120 positioned on the front opening 60*a* side. The lead wire 65 is extended to the outside of the reflecting mirror 60 through an opening 62 for lead wire of the reflecting mirror 60. The lamp base 55 is attached to the other sealing portion 120' of the discharge lamp 1000, and the sealing portion 120' attached with the lamp base 55 is attached to the reflecting mirror 60**.

The front glass is provided at the front opening **60*a* of the reflecting mirror 60, so that lamp unit 1200 is of an airtight structure. Therefore, when the lamp 1000 is heated, the temperature in the lamp unit 1200 becomes very high. Accordingly, the lamp 1000 is designed and produced with an estimation of the temperature of the lamp 1000 in the lamp unit 1200** to guarantee the lamp operation.

However, the inventors of the present invention found that when the conventional lamp unit 1200 is used as the light source of a DLP projector, the temperature of the welded portion 132 of the sealing portion 120 positioned on the emission direction 50 side became higher than estimated, and the welded portion 132 is oxidized and the lamp 1000 stops operating. In other words, molybdenum constituting the external lead 130 and the Mo foil 124 has the property of being oxidized at a temperature over 350° C., and in addition, the molybdenum portion is positioned in the end of the sealing portion 120 and is in contact with ambient air. Therefore, when the temperature of the welded portion 132 that is more likely to be heated than other portions because of the contact resistance is increased to about 350° C. or more, the welded portion 132 is oxidized (oxidization of molybdenum), and as a result, the conductivity of the welded portion 132 is lost, so that the lamp 1000 stops operating.

When the inventors of the present invention made research on what causes the temperature of the welded portion 132 to be higher than the temperature estimated at the time of design, they found that as shown in FIG. 7, reflected light 52 from an optical system 90 of a DLP projector disposed forward in the emission direction 50 of the lamp unit 1200 is incident to the reflecting mirror 60 of the lamp unit 1200, and the welded portion 132 of the sealing portion 120 positioned on the emission direction 50 side is irradiated with the reflected light 52. For example, in the case of a single panel DLP projector, the optical system 90 includes a color foil 70 of three primary colors (R, G, and B) disposed forward in the emission direction 50 of the lamp unit 1200 and a DMD panel 80 (constituted by a plurality of DMDs 82) for reflecting light that has passed through the color foil 70. The emitted light 51 from the lamp unit 1200 passes through the color foil 70 rotating at a rotation speed of, for example, 120 rotations per second, and becomes, for example, a red (R) light 54, which is projected on the DMD panel 80 via a condensing lens (not shown). In this case, the light of the emitted light 51 from the lamp unit 1200 that has not passed through the color foil 70 is incident again to the reflecting mirror 60 of the lamp unit 1200 as the reflected light 52 from the color foil 70.

The reflected light 52 incident to the reflecting mirror 60 is reflected at the reflecting mirror 60, and as shown in FIG. 8A, the welded portion 132 of the sealing portion 120 on the emission direction 50 side is irradiated with reflected light 53 from the reflecting mirror 60. Thus, because of the influence of the light 53 irradiating the welded portion 132, the temperature of the welded portion 132 of the sealing portion 120 becomes higher than the estimated temperature of the lamp unit alone without being in combination with the optical system 90. For example, the temperature may be about 50° C. higher than the temperature estimated at the time of design.

Under the circumstances that a light source having a high intensity is in demand to improve the performance of DLP projectors, it is not desirable to reduce the output of the discharge lamp 100 (reduce the intensity) for the purpose of restricting the temperature of the welded portion 132 to not more than about 350° C. during lamp operation. Furthermore, in light of the properties of molybdenum, it is difficult to achieve the welded portion 132 that is not oxidized at a temperature over about 350° C.

Furthermore, the inventors of the present invention found that in operation in the structure shown in FIG. 7, the temperature of the sealing portion 120 is not uniformly increased, but the temperature of certain portions of the sealing portion 120 (e.g., a portion A where the welded portion 132 is sealed) is locally increased, as shown in FIG. 8B. In other words, they found that the sealing portion 120 is not uniformly irradiated with the reflected light 53 from the reflecting mirror 60, and a region (temperature focus region) 45 in which the temperature of the sealing portion 120 is a maximum is formed. Therefore, in the case where the welded portion 132 is positioned in the temperature focus region 45, the temperature of the welded portion 132 is even higher than the temperature estimated with the lamp unit alone.

SUMMARY OF THE INVENTION

Therefore, with the foregoing in mind, it is a main object of the present invention to provide a discharge lamp and a lamp unit having improved reliability that is achieved by suppressing the temperature increase in the connection portion (welded portion) in the sealing portion.

A discharge lamp of the present invention includes a luminous bulb in which a luminous material is enclosed and a pair of electrodes are opposed to each other in the luminous bulb; and a pair of sealing portions for sealing a pair of metal foils electrically connected to the pair of electrodes, respectively. Each of the pair of metal foils has an external lead on a side opposite to a side electrically connected to a corresponding electrode of the pair of electrodes. At least one of the pair of sealing portions is provided with a reflective film on a surface of the sealing portion in a portion where a connection portion of the external lead and the metal foil is sealed, the reflective film containing a material having a reflectance larger than that of a material constituting the sealing portion.

It is preferable that the reflective film contains a material having a heat radiation rate larger than that of the material constituting the sealing portion.

In one embodiment of the present invention, the connection portion is a welded portion where the external lead formed of molybdenum is connected to the metal foil formed of molybdenum by welding.

A lamp unit of the present invention includes a discharge lamp and a reflecting mirror for reflecting light emitted from the discharge lamp. The discharge lamp includes a luminous bulb in which a luminous material is enclosed and a pair of electrodes are opposed to each other in the luminous bulb; and a pair of sealing portions for sealing a pair of metal foils electrically connected to the pair of electrodes, respectively. Each of the pair of metal foils has an external lead on a side opposite to a side electrically connected to a corresponding electrode of the pair of electrodes. One of the pair of sealing portions is disposed on an emission direction side in the reflecting mirror. The one sealing portion disposed on the emission direction side is provided with a reflective film on a surface of the sealing portion in a portion where a connection portion of the external lead and the metal foil is sealed, the reflective film containing a material having a reflectance larger than that of a material constituting the sealing portion. The reflective film reflects light incident to the reflecting mirror from an optical system disposed forward in the emission direction and irradiating the connection portion, thereby suppressing a temperature increase in the connection portion.

It is preferable that the reflective film contains a material having a heat radiation rate larger than that of the material constituting the sealing portion.

Another lamp unit of the present invention includes a discharge lamp and a reflecting mirror for reflecting light emitted from the discharge lamp. The discharge lamp includes a luminous bulb in which a luminous material is enclosed and a pair of electrodes are opposed in the luminous bulb; and a pair of sealing portions for sealing a pair of metal foils electrically connected to the pair of electrodes, respectively. Each of the pair of metal foils has an external lead on a side opposite to a side electrically connected to a corresponding electrode of the pair of electrodes. One of the pair of sealing portions is disposed on an emission direction side in the reflecting mirror. The one sealing portion disposed on the emission direction side includes a temperature focus region where a temperature of the sealing portion is a maximum that occurs because of light incident to the reflecting mirror from an optical system disposed forward in the emission direction and irradiating the connection portion. The connection portion in the one sealing portion where the external lead and the metal foil are connected is provided in a position outside the temperature focus region, thereby suppressing a temperature increase in the connection portion.

In one embodiment of the present invention, the connection portion is a welded portion where the external lead formed of molybdenum is connected to the metal foil formed of molybdenum by welding.

In one embodiment of the present invention, the optical system comprises a reflection type imaging device, and a color foil for projecting emitted light from the reflecting mirror on the reflection type imaging device, and light irradiating the connection portion includes at least light that is a part of light emitted from the reflecting mirror toward the optical system, and is reflected by the color foil and incident to the reflecting mirror.

An image display apparatus of the present invention includes the above-described lamp unit, and an optical system using the lamp unit as a light source.

In one embodiment of the present invention, the optical system includes a digital micromirror device.

In the discharge lamp of the present invention, a reflective film is formed on the surface of a portion where a connection portion of the sealing portion is sealed. Therefore, light irradiating the connection portion can be reflected by the reflective film, and thus the temperature increase in the connection portion can be suppressed. In the case where the reflective film includes a material having a large heat radiation rate, the radiation of the reflective film also can suppress the temperature increase in the connection portion.

Furthermore, when such a discharge lamp and a reflecting mirror is combined, light that is incident to the reflecting mirror from the optical system disposed forward in the emission direction and irradiates the connection portion can be reflected by the reflective film. As a result, a lamp unit in which the temperature increase in the connection portion is suppressed can be provided. Furthermore, in another lamp unit of the present invention, the connection portion is provided in a position outside the temperature focus region of the sealing portion, so that the temperature increase in the connection portion can be suppressed, compared with the case where the connection portion is provided within the temperature focus region. The connection portion is, for example, the welded portion where the external lead formed of molybdenum and the metal foil formed of molybdenum are connected by welding. In the case where the optical system has a reflection type imaging device and a color foil, light irradiating the connection portion includes at least light reflected by the color foil and incident to the reflecting mirror. Furthermore, an image display apparatus can be provided by using such a lamp unit as the light source and combining an optical system (e.g., an optical system including a DMD as a component) therewith.

The present invention can provide a discharge lamp and a lamp unit having improved reliability that is achieved by suppressing the temperature increase in the connection portion in the sealing portion. Furthermore, it is possible to provide an image display apparatus by combining such a lamp unit and an optical system.

This and other advantages of the present invention will become apparent to those skilled in the art upon reading and understanding the following detailed description with reference to the accompanying figures.

DETAILED DESCRIPTION OF THE INVENTION

Figure 1A:
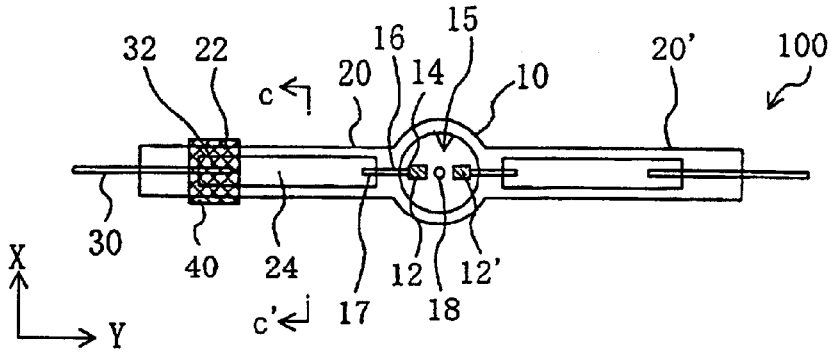
FIG. 1A is a schematic top view showing the structure of a discharge lamp 100 of Embodiment 1.

Hereinafter, embodiment of the present invention will be described with reference to the accompanying drawings. In the following drawings, for simplification, the elements having substantially the same functions bear the same reference numeral.

Embodiment 1

A discharge lamp 100 of Embodiment 1 of the present invention will be described with reference to FIGS. 1 to 3.

Figure 1B:
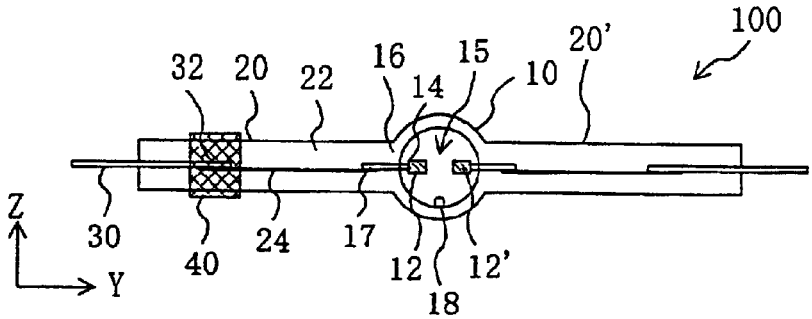
FIG. 1B is a schematic side view showing the structure of the discharge lamp 100.
Figure 1C:
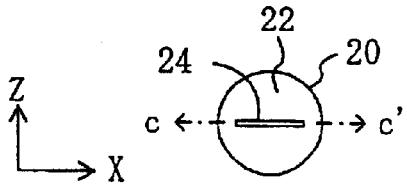
FIG. 1C is a cross-sectional view taken along line c–c' of FIG. 1A.

First, FIGS. 1A to 1C are referred to. FIG. 1A is a schematic top view showing the structure of a discharge lamp 100 of Embodiment 1. FIG. 1B is a schematic side view showing the structure of the discharge lamp 100. FIG. 1C is a cross-sectional view taken along line c–c' of FIG. 1A. The arrows X, Y and Z in FIGS. 1A to 1D show the coordinate axes.

The discharge lamp 100 of Embodiment 1 includes a luminous bulb 10, and a pair of sealing portions 20 and 20' connected to the luminous bulb 10. A discharge space 15 in which a luminous material 18 is enclosed is provided inside the luminous bulb 10. A pair of electrodes 12 and 12' are opposed to each other in the discharge space 15. The luminous bulb 10 is made of quartz glass and is substantially spherical. The outer diameter of the luminous bulb 10 is, for example, about 5 mm to 20 mm. The glass thickness of the luminous bulb 10 is, for example, about 1 mm to 5 mm. The volume of the discharge space 15 in the luminous bulb 10 is, for example, about 0.01 to 1 cc. In this embodiment, the luminous bulb 10 having an outer diameter of about 13 mm, a glass thickness of about 3 mm, a volume of the discharge space 15 of about 0.3 cc is used. As the luminous material 18, mercury is used. For example, about 150 to 200 mg /$cm^3$ of mercury, a rare gas (e.g., argon) with 5 to 20 kPa, and a small amount of halogen are enclosed in the discharge space 15. In FIGS. 1A and 1B, mercury 18 attached to the inner wall of the luminous bulb 10 is schematically shown.

The pair of electrodes 12 and 12' in the discharge space 15 is arranged with a gap (arc length) of, for example, about 1 to 5 mm. As the electrodes 12 and 12', for example, tungsten electrodes (W electrodes) are used. In this embodiment, the W electrodes 12 and 12' are arranged with a gap of about 1.5 mm. A coil 14 is wound around the head of each of the electrodes 12 and 12'. The coil 14 has a function to lower the temperature of the electrode head. The electrode axis (W rod) 16 of the electrode 12 is electrically connected to the metal foil 24 in the sealing portion 20. Similarly, the electrode axis 16 of the electrode 12' is electrically connected to the metal foil 24' in the sealing portion 20'.

The sealing portion 20 includes a metal foil 24 electrically connected to the electrode 12 and a glass portion 22 extended from the luminous bulb 10. The airtightness in the discharge space 15 in the luminous bulb 10 is maintained by the foil-sealing between the metal foil 24 and the glass portion 22. The metal foil 24 is a molybdenum foil (Mo foil), for example, and has a rectangular shape, for example. The glass portion 22 is made of quartz glass, for example. The structure of the sealing portion 20' is the same as that of the sealing portion 20, so that the description thereof is omitted.

The metal foil 24 in the sealing portion 20 (or 20') is joined to the electrode 12 by welding, and the metal foil 24 has an external lead 30 on the side opposite to the side on which the electrode 12 is joined. The external lead 30 is formed of, for example, molybdenum, and is connected to the metal foil 24, for example, by welding. At least one sealing portion 20 of the pair of sealing portions is provided with a reflective film 40 on the surface of the portion where the connection portion (welded portion) 32 of the external lead 30 and the metal foil 24 is sealed. The reflective film 40 includes a material having a reflectance larger than that of the material (quartz glass) constituting the sealing portion 20, and typically is formed of such a material. Examples of the material contained in the reflective film 40 include aluminum nitride, aluminum, alumina, and zirconia. The reflective film 40 has a function to reflect light irradiating the connection portion of the sealing portion, and therefore the temperature increase of the connection portion 32 during lamp operation can be suppressed. It is preferable that the reflective film 40 is typically a specular film (e.g., metal thin film) or a white film to cause reflection satisfactorily without deteriorating the lamp characteristics. The thickness of the reflective film 40 is for example, about several thousand angstroms to 1 mm.

In the case where the reflective film 40 includes a material having a heat radiation rate larger than that of quartz glass (e.g., aluminum nitride, etc.), preferably, the reflective film 40 is formed of such material, the radiation of the reflective film 40 also can suppress the temperature increase of the connection portion 32. For reference, the reflectance and the heat radiation rate of aluminum nitride are about 90% and about 90%, respectively.

It is sufficient that the reflective film 40 is formed at least on the surface of the portion where the connection portion 32 is sealed of the sealing portion 20 positioned on the emission direction side of the lamp. However, it is possible to form the reflective film 40 on the entire sealing portion 20 for the purpose of suppressing the temperature increase of the entire sealing portion 20. Furthermore, it is preferable to form the reflective film 40 on the portion where the connection portion 32 of the other sealing portion 20' is sealed or on the entire sealing portion 20'. There is no limitation regarding the method for forming the reflective film 40, and for example, coating, dipping or brush painting can be used.

Figure 2:
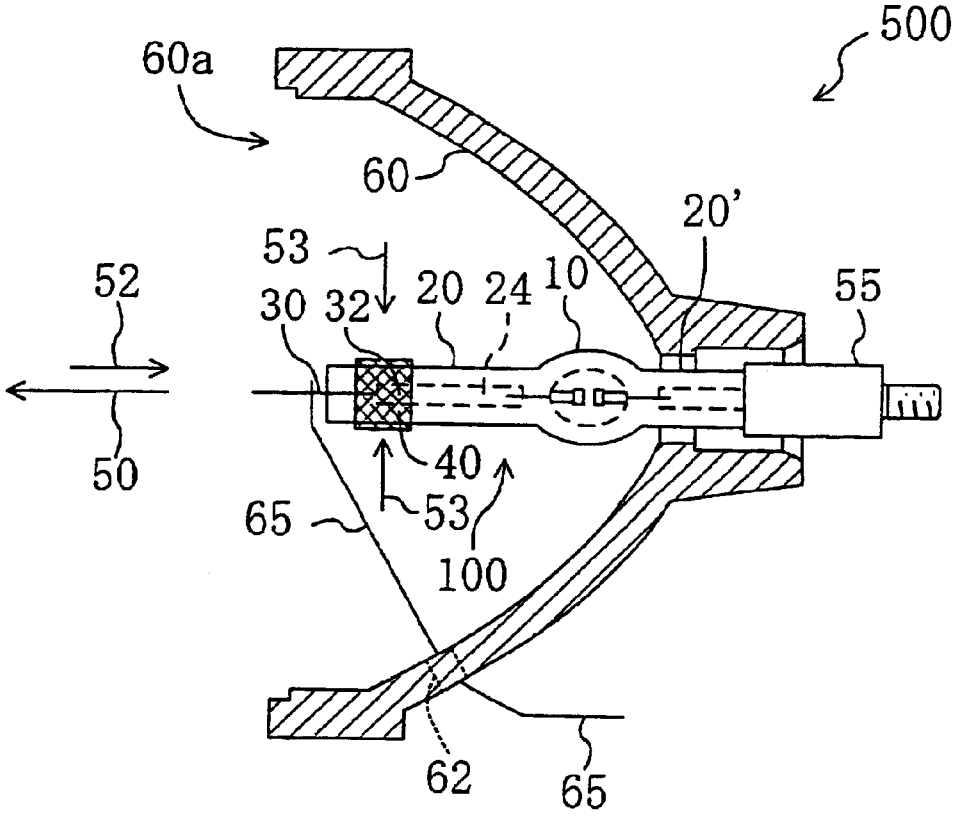
FIG. 2 is a schematic cross-sectional view showing the structure of a lamp unit 500 of Embodiment 1.

As shown in FIG. 2, the discharge lamp 100 provided with the reflective film 40 can be formed into a lamp unit 500 in combination with a reflecting mirror 60. FIG. 2 is a schematic cross-sectional view of the lamp unit 500 including the discharge lamp 100.

The lamp unit 500 includes the discharge lamp 100 including the sealing portion 20 provided with the reflective film 40 and the reflecting mirror 60 for reflecting light emitted from the discharge lamp 100. The sealing portion 20 provided with the reflective film 40 is provided on the front opening 60*a* side (emission direction 50 side) of the reflecting mirror 60. The other sealing portion 20' is fixed to the reflecting mirror 60. The reflective film 40 provided in the sealing portion 20 is formed on the surface of the portion of the sealing portion 20 where the connection portion 32 is sealed. The reflecting mirror 60 fixed to the sealing portion 20' is designed to reflect the radiated light from the mercury lamp 100 such that the light becomes, for example, a parallel luminous flux, a focused luminous flux converged on a predetermined small area, or a divergent luminous flux equal to that emitted from a predetermined small area. As the reflecting mirror 60, a parabolic reflector or an ellipsoidal mirror can be used, for example.

A lamp base 55 is attached to one sealing portion 20' of the discharge lamp 100, and the external lead (not shown) extending from the sealing portion 20' and the lamp base 55 are electrically connected. The sealing portion 20' attached with the lamp base 55 is adhered to the reflecting mirror 60, for example, with an inorganic adhesive (e.g., cement) so that they are integrated. A lead wire 65 is electrically connected to the external lead 30 of the sealing portion 20 positioned on the front opening side of the reflecting mirror 60. The lead wire 65 extends from the external lead 30 to the outside of the reflecting mirror 60 through an opening 62 for a lead wire of the reflecting mirror 60. For example, a front glass can be attached to the front opening of the reflecting mirror 60.

Figure 3:
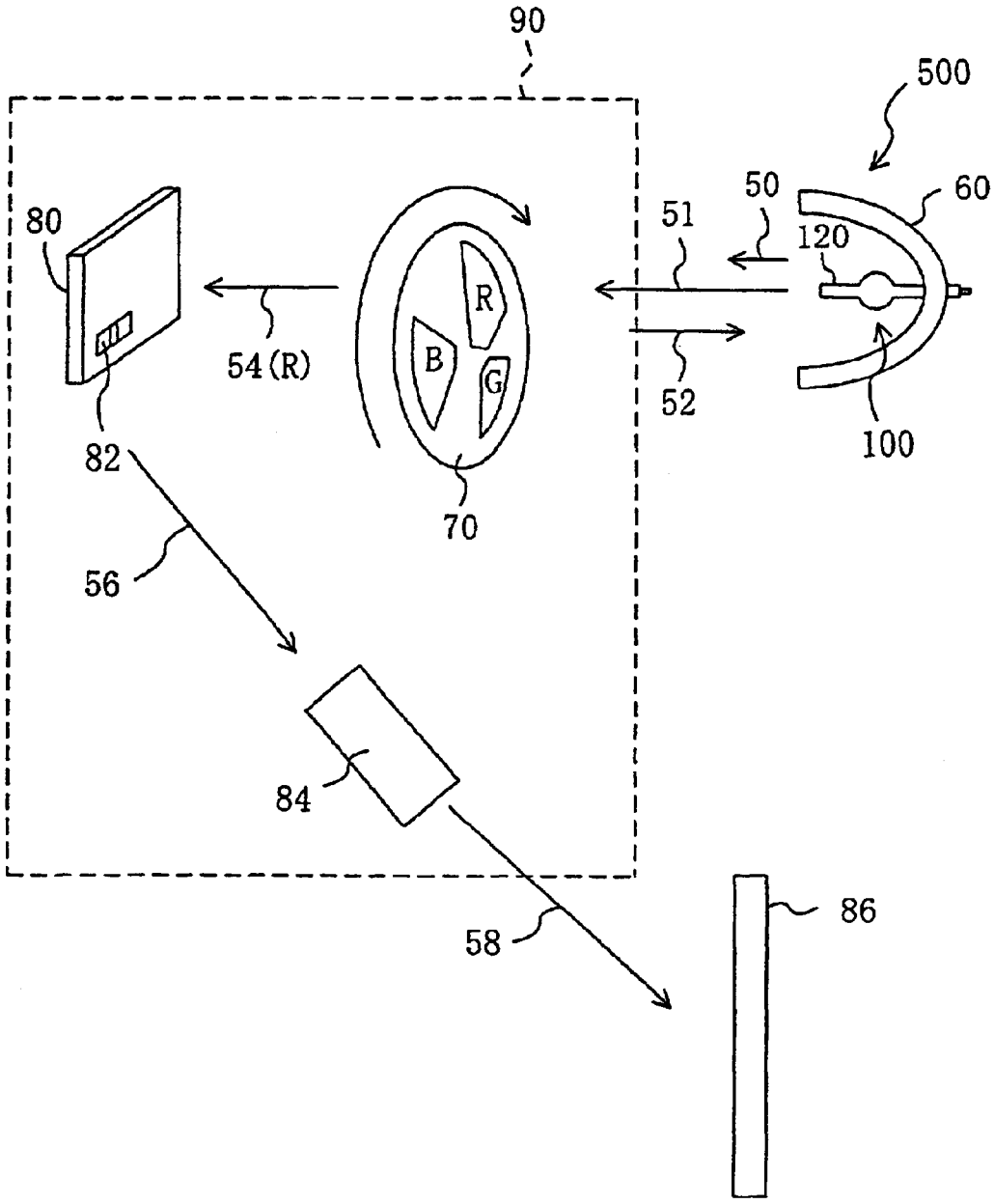
FIG. 3 is a schematic view showing the structure of a lamp unit 500 and an optical system 90.

The lamp unit 500 can be used as the light source for a DLP projector, as shown in FIG. 3. FIG. 3 is a schematic view showing the structure of a single panel DLP projector, and the DLP projector shown in FIG. 3 includes the lamp unit 500 and an optical system 90. The optical system 90 includes a color foil 70 disposed forward in the emission direction 50 of the lamp unit 500, a DMD panel 80 (constituted by a plurality of DMDs 82) for reflecting light 54 that has passed through the color foils 70, a projection lens 84 for converting light 56 projected from the DMD panel 80 to projection light 58 to form images on a screen 86.

After the light 51 emitted from the lamp unit 500 has passed through one color (e.g., R) of three primary colors (R, G and B) of the color foil 70 rotating, for example, at a rotation speed of 120 rotations per second, the light is projected to the DMD panel 80 via a condensing lens (not shown), and then images are formed on the screen 86. In the case of a single panel DLP projector, the DMDs 82 of the DMD panel 80 are turned on and off repeatedly at a speed of several thousand or several ten thousand times per second, so that the colors of R, G and B that have passed through the color foil 70 are superimposed instantly so as to form a picture on the screen 86, utilizing an afterimage effect of human eyes.

The light that has not passed through the color foil 70 of the emitted light 51 from the lamp unit 500 is incident again to the reflecting mirror 60 of the lamp unit 500 as the reflected light 52. As shown in FIG. 2, the connection portion 32 of the sealing portion 20 is protected with the reflective film 40. Therefore, even if the reflected light 52 is incident to the reflecting mirror 60, the light 53 irradiating the connection portion 32 can be reflected. Thus, the temperature increase in the connection portion 32 can be suppressed. As a result, the reliability of the lamp operation of the lamp unit 500 can be improved. Since the protection of the connection portion 32 by the reflective film 40 can suppress the temperature increase in the connection portion due to the light 52 incident to the reflecting mirror 60 from the optical system disposed forward in the emission direction 50 of the lamp unit 500, it is possible to suppress the temperature increase in the connection portion caused by not only the light 52 from the optical system 90 of a single panel DLP projector as described in this embodiment, but also light incident to the reflecting mirror 60 from the optical system of a three panel DLP projector using three DMD panels 80 or light incident to the reflecting mirror 60 from the optical system of a liquid crystal projector using a liquid crystal panel.

Embodiment 2

Referring to FIG. 4, Embodiment 2 of the present invention will be described. This embodiment is different from Embodiment 1 in that the connection portion is provided in a position outside the temperature focus region 45, whereas in Embodiment 1, the reflective film 40 is formed in the portion of the sealing portion 20 where the connection portion 32 is sealed. For simplification, in the following description of this embodiment, different points from those in Embodiment 1 will be primarily described, and the same points as in Embodiment 1 will be omitted or simplified.

Figure 4A:
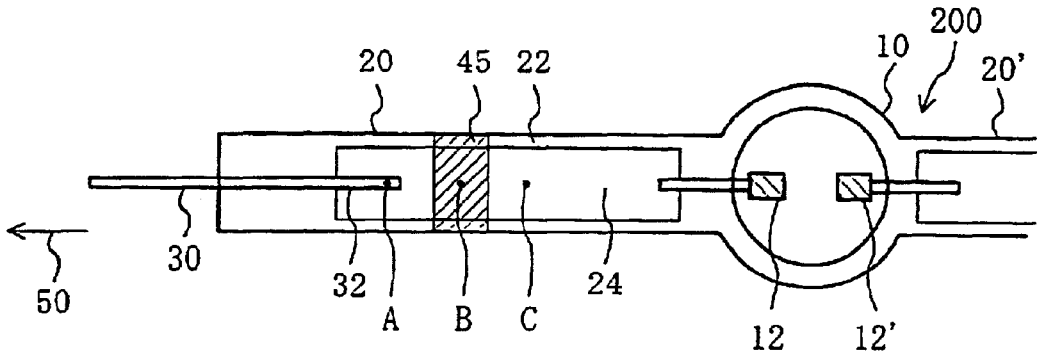
FIG. 4A is a schematic partial enlarged cross-sectional view showing the structure of a discharge lamp 200 of Embodiment 2.
Figure 4B:
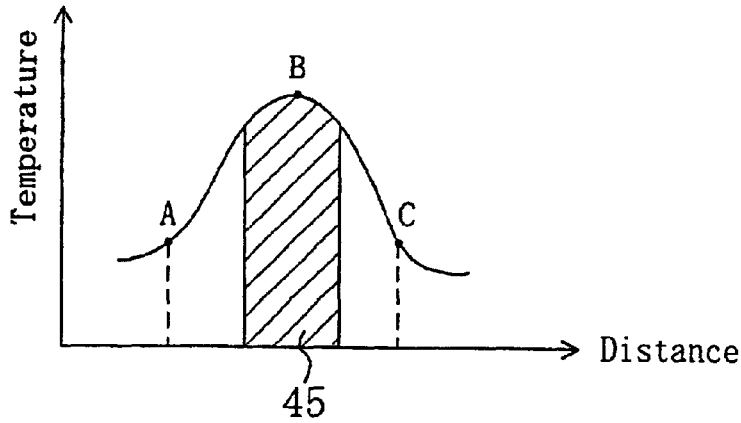
FIG. 4B is a graph schematically showing the temperatures at predetermined portions A, B and C of the sealing portion 20.
Figure 5:
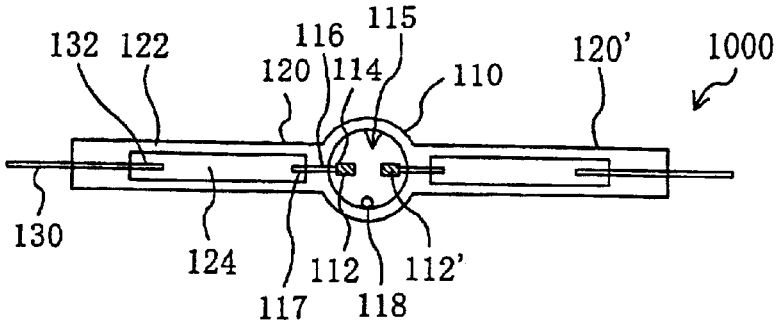
FIG. 5 is a schematic view showing the structure of a conventional discharge lamp 1000.
Figure 6:
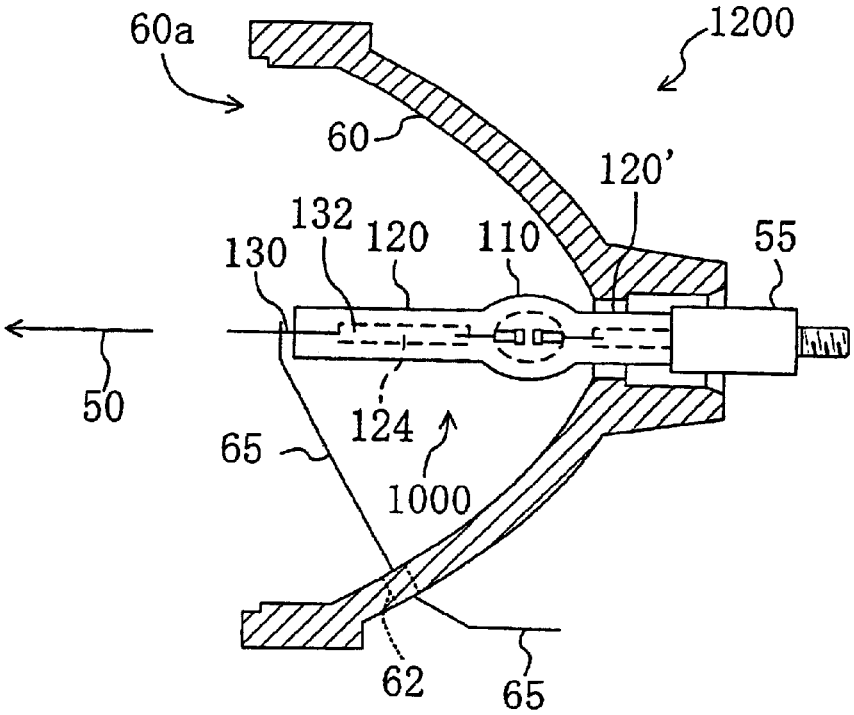
FIG. 6 is a schematic cross-sectional view showing the structure of a conventional discharge lamp 1200.
Figure 7:
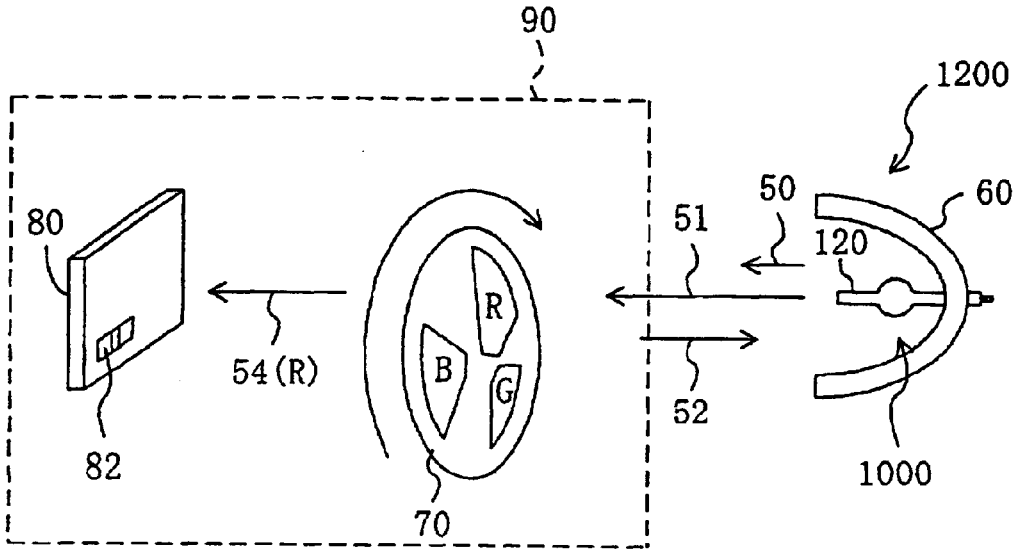
FIG. 7 is a schematic view showing the structure of the lamp unit 1200 and an optical system 90.
Figure 8A:
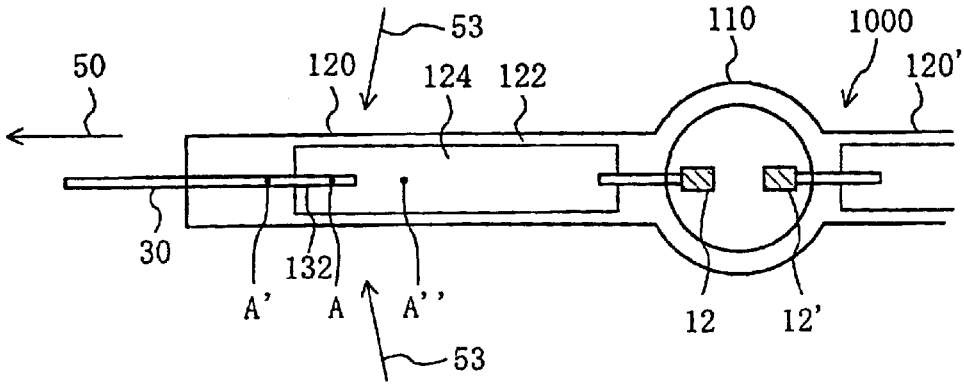
FIG. 8A is a schematic partial enlarged cross-sectional view showing the structure of a discharge lamp 1000.
Figure 8B:
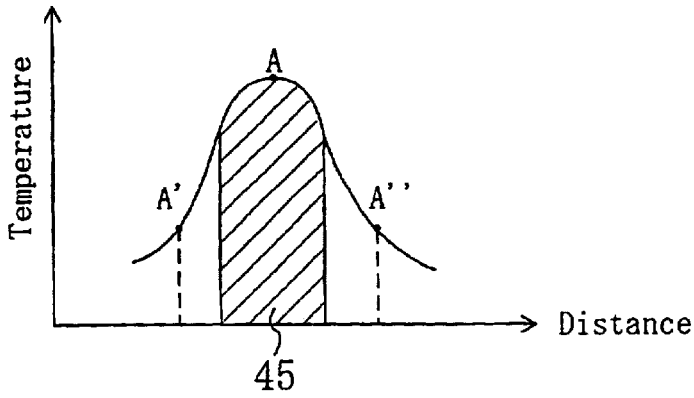
FIG. 8B is a graph schematically showing the temperatures at predetermined portions of the sealing portion 120.

FIG. 4A is a schematic partial enlarged cross-sectional view of the discharge lamp 200 to be combined with the reflecting mirror 60. FIG. 4B schematically shows the temperature at predetermined portions A, B and C of the sealing portion 20.

As shown in FIGS. 4A and 4B, a region (temperature focus region) 45 where the temperature of the sealing portion 20 is a maximum during operation is formed, for example, because of the reflected light 52 from the optical system 90 shown in FIG. 3. In the discharge lamp 200 of this embodiment, the connection portion 32 is provided in a position outside the temperature focus region 45, thereby suppressing the temperature increase in the connection portion 32. The portion of the sealing portion 20 where temperature focus region 45 is formed can be identified by previously measuring the temperature of predetermined portions of the sealing portion 20, for example with a thermocouple to locate the region having the maximum temperature in the sealing portion. Then, the discharge lamp is designed and produced such that the connection portion 32 is not within the temperature focus region 45, and thus the discharge lamp 200 can be obtained. Furthermore, the connection portion 32 can be provided in a position outside the temperature focus region 45 by designing the reflecting mirror 60 such that the connection portion 32 of the sealing portion 20 is not within the temperature focus region 45.

In this embodiment, the connection portion 32 is provided in a position of the sealing portion 20 that is outside the temperature focus region 45. Therefore, the temperature increase in the connection portion 32 can be suppressed so that the reliability can be improved. Furthermore, it is preferable to combine this embodiment and Embodiment 1. In other words, when the connection portion 32 is provided in a position outside the temperature focus region 45 and the reflective film 40 is formed in the portion of the sealing portion 20 where the connection portion 32 is sealed, then the temperature increase in the connection portion 32 can be suppressed further.

Other Embodiments

In the above embodiments, mercury lamps employing mercury as the luminous material have been described as an example of the discharge lamp of the present invention. However, the present invention can apply to any discharge lamps in which the metal foil 24 is sealed by the sealing portion (seal portion). For example, the present invention can apply to discharge lamp enclosing a metal halide such as a metal halide lamp.

In the above embodiments, the mercury vapor pressure is about 20 MPa (in the case of so-called ultra high pressure mercury lamps). However, the present invention can apply to high-pressure mercury lamps in which the mercury vapor pressure is about 1 MPa, or low-pressure mercury lamps in which the mercury vapor pressure is about 1 kPa. Furthermore, the gap (arc length) between the pair of electrodes 12 and 12' can be short, or can be longer than that. The discharge lamps of the above embodiments can be used by any lighting method, either alternating current lighting or direct current lighting.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image display apparatus comprising a lamp unit including a discharge lamp and a reflecting mirror for reflecting light emitted from the discharge lamp, and an optical system using the lamp unit as a light source, the discharge lamp comprising:

a luminous bulb in which a luminous material is enclosed and a pair of electrodes are opposed in the luminous bulb; and a pair of sealing portions for sealing a pair of metal foils electrically connected to the pair of electrodes, respectively, and joining with the luminous bulb;

wherein each of the pair of metal foils includes an external lead on a side opposite to a side electrically connected to a corresponding electrode of the pair of electrodes, one of the pair of sealing portions is disposed on a emission direction side in the reflecting mirror, the one sealing portion disposed on the emission direction side having a temperature focus region which occurs because of light reflected from the optical system disposed forward in the emission direction and incident to the reflecting mirror, thereby irradiating the one sealing portion, wherein the temperature focus region exhibits a temperature that is higher than at other regions on and along the one sealing portion and is less than at a focal point provided in the luminous bulb of the reflective mirror, and, a connection portion in the one sealing portion, where the external lead and the metal foil are connected, is provided in a position outside the temperature focus region, thereby suppressing a temperature increase in the connection portion wherein the optical system comprises a reflection type imaging device, and a color foil for projecting emitted light from the reflecting mirror on the reflection type imaging device, and light irradiating the connection portion includes at least light that is a part of light emitted from the reflecting mirror toward the optical system, and is reflected by the color foil and incident to the reflecting mirror.

2. The image display apparatus of claim 1, wherein the optical system includes a digital micromirror device.

3. The image display apparatus of claim 1, wherein the connection portion is provided with a reflective film containing a material having a reflectance larger than that of a material constituting the sealing portion.

4. The image display apparatus of claim 3, wherein the reflective film contains a material having a heat radiation rate larger than that of the material constituting the sealing portion.

5. The image display apparatus of claim 1, wherein the connection portion is a welded portion where the external lead formed of molybdenum is connected to the metal foil formed of molybdenum by welding.

* * * * *

UNITED STATES PATENT AND TRADEMARK OFFICE

CERTIFICATE OF CORRECTION

PATENT NO. : 6,734,628 B2
DATED : May 11, 2004
INVENTOR(S) : Tomoyuki Seki et al.

It is certified that error appears in the above-identified patent and that said Letters Patent is hereby corrected as shown below:

Column 10,
Line 39, "a" should be -- an --

Signed and Sealed this

Seventh Day of December, 2004

JON W. DUDAS
*Director of the United States Patent and Trademark Office*